United States Patent [19]

Alpkvist et al.

[11] 4,255,122

[45] Mar. 10, 1981

[54] APPARATUS FOR COMBUSTING LIQUID, GASEOUS OR POWDERED FUELS

[75] Inventors: Jan Å. Alpkvist; Rolf G. A. Törnkvist; Lars R. Würzig, all of Linköping, Sweden

[73] Assignee: Forenade Fabriksverken, Eskiluna, Sweden

[21] Appl. No.: 878,260

[22] Filed: Feb. 16, 1978

[30] Foreign Application Priority Data

Feb. 23, 1977 [SE] Sweden ..... 7701991
Feb. 23, 1977 [SE] Sweden ..... 7701992

[51] Int. Cl.[3] ..... F23D 11/44

[52] U.S. Cl. ..... 431/215; 431/351; 60/737

[58] Field of Search ..... 431/351, 352, 215, 210, 431/182; 60/39.65, 39.69, 39.71

[56] References Cited

U.S. PATENT DOCUMENTS

| | | | |
|---|---|---|---|
| 2,621,477 | 12/1952 | Powter et al. | 60/39.71 |
| 2,628,475 | 2/1953 | Heath | 60/39.71 |
| 2,706,889 | 4/1955 | Allen et al. | 60/39.71 |
| 2,807,316 | 9/1957 | Jackson | 431/352 |
| 2,810,260 | 10/1957 | Fromm et al. | 60/39.71 |
| 2,930,191 | 2/1960 | Schirmer et al. | 60/39.71 |
| 3,174,526 | 3/1965 | Von Linde | 431/116 |
| 3,360,929 | 1/1968 | Drewry | 60/39.65 |
| 3,531,937 | 10/1970 | Sneeden | 60/39.71 |
| 3,564,847 | 1/1971 | Wagner | 60/39.71 |
| 3,757,522 | 9/1973 | Carvel et al. | 60/39.71 |

*Primary Examiner*—Samuel Scott
*Assistant Examiner*—Lee E. Barrett
*Attorney, Agent, or Firm*—James Creighton Wray

[57] ABSTRACT

A burner pumps fuel through a fuel line and pumps air into a chamber. Air from the chamber and fuel from the fuel line enter a mixing chamber. The fuel and air mixture flow through an evaporator tube which extends into a combustion chamber and turns at two successive 90° angles and releases the mixture in an opening facing the bottom of the chamber. Combustion air flows through the air chamber outward parallel to the combustion chamber walls in a labyrinth and then into an expansion chamber through air slots and past flow directing wings which give the combustion air a screw direction. Exhaust gas flows outward around the outer walls of the labyrinth. The evaporator tube has an outer area to inner volume ratio of 0.3 to 0.8.

15 Claims, 4 Drawing Figures

APPARATUS FOR COMBUSTING LIQUID, GASEOUS OR POWDERED FUELS

Figure 1:
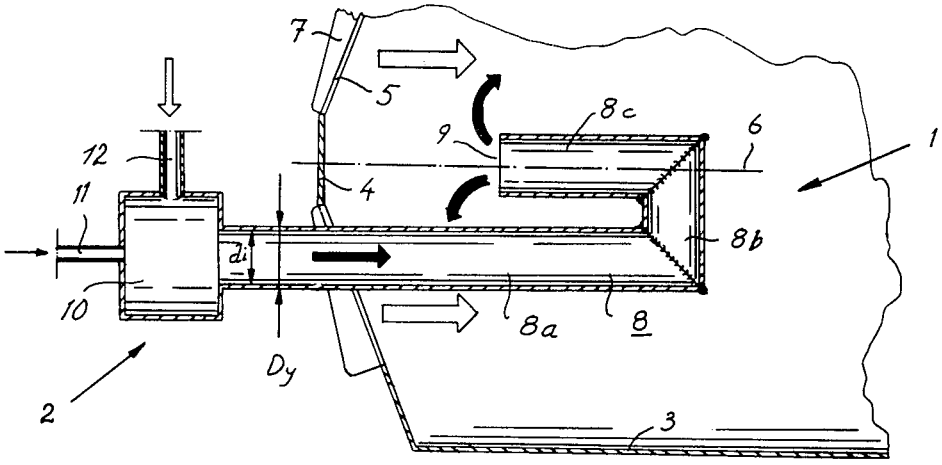

The present invention relates to a method and an apparatus for combusting liquid, gaseous or powdered fuels, especially combusting said fuels at a relatively low pressure both for the fuel and the air for combustion.

The main object of the invention is to provide a method and an apparatus for obtaining highly efficient combustion with small dimensions of the burner, whereby existing problems in previously known methods and apparatus for instance imperfect combustion, high content of carbon monoxide, high content of nitrogen monoxide coke formation in the burner head etc., overheating of different parts of the burner etc. are avoided. The method and the apparatus can be utilized in many different technical fields and for many different purposes, for instance in connection with burners for fire places, steam engines and steam turbines, gas turbines, hot air motors and hot gas motors etc.

Burners are previously known which comprise a burner head through which a liquid fuel is forced under high pressure, whereby the fuel is atomized when leaving the burner head, or in which the fuel by means of air under high pressure is forced through the said burner head, whereby the liquid is likewise atomized when leaving said burner head. Such burners are disadvantageous in several respects. They have a relatively narrow range of regulation. The diverging angle for the atomized fuel changes depending on the pressure and the speed of the ejected fuel. There is a risk of coke formation clogging the burner head, the burner requires a high pressure pump for the fuel or the injection air, the burning flame is often long and the heat is concentrated in the flame to an area located a distance spaced from the burner head, there are high demands on the properties of the seals, the closing valves and other equipment, the burner head is worn relatively quickly, the combustion is relatively uneven and incomplete leaving a high content of carbon monoxide and nitrogen monoxide in the exhaust gases, and the burner has a relatively low capacity and therefore has to be made with relatively large dimensions.

It has been suggested that a burner be provided with a rotatable diffuser instead of the above mentioned compression head, and such rotatable diffusers may be formed as a rotatable hollow disc having a large number of small bores around the periphery thereof from which the fuel is thrown out depending on the centrifugal force. Such burners can give a better combustion than the previously mentioned apparatus having pressure burner heads, and the main advantage thereof is that there is no need for a high pressure pump for the fuel or the combustion air. The apparatus is however disadvantageous in other respects: Also in this burner there is a risk for clogging and coke formation in the small bores at the periphery of the burner disc, there is a need for a motor having a very high speed for throwing the fuel out, which motor necessitates a high manufacturing precision both as concerns the electrical parts and the mechanical parts, especially bearings and mounting devices etc., and depending on the very small tolerances such motor is relatively expensive. As in the above mentioned burners having pressure burner heads, the atomizing of the fuel also is made of small drops, but even at relatively finely atomizing pressure heads or rotatable burner heads the atomizing of the fuel gives comparatively large drops which generally do not allow an optimum good combustion. Also in rotating diffusers the fuel is thrown relatively far from the diffuser and therefore also the burner for such diffusers have to be made with relatively large dimensions.

Both burners having pressure heads and burners having rotatable diffusers are disadvantageous in that they require liquid, generally relatively light fuels, and generally they do not make possible combustion of heavy fuels, mixtures of heavy and light fuels or powdered solid fuels.

It is an object to form the burner with a capacity which is as high as possible and at the same time with dimensions which are as small as possible without involving a risk of false function like overheating, burning to pieces of the burner head or other parts included in the burner or any other disadvantages. It has been previously suggested that the burner be formed as a combustion chamber into which one or more tube-formed burner heads open and in which the fuel which is ejected from the burner head is mixed with the combustion air in the combustion chamber, and in which at least some portion of the burner head extends inside the burner chamber. This gives the essential advantage that the burner head or the burner tube is heated so that the fuel is vaporized in the burner tube and an improved atomizing of the fuel and an improved combustion is obtained. In a special embodiment of this previously suggested burner the burner tube is bent 180° and the mouth thereof is facing the bottom of the burner chamber, whereby the fuel is mechanically decomposed when being subjected to friction during the flow thereof against the walls of the burner tube and it hits the walls thereof at the 180° bow at the same time as the fuel is vaporized depending on the high temperature. Due to the said vaporization the burner tube is generally called an evaporator tube. Burners having an evaporator tube give several advantages as compared with the previously mentioned burners. They can for instance act at low pressure both or the fuel and the combustion air, there is practically no risk of clogging or coke formation of the evaporator tube, they can be used for different types of liquid or powdered fuels or mixtures thereof, they have a significantly high capacity and they give an essentially improved combustion and a lower content of carbon monoxide and nitrogen monoxide than the above mentioned previously known burners.

Burners having an evaporator tube however are disadvantageous in that there is a risk of overheating both of the burner chamber and the evaporator tube depending on the high capacity of the burner and the high working temperatures. It has been shown that the evaporator tube at the bowed portion thereof is easily burnt to pieces if the U-formed bow is rounded and it has also been that there is a risk of overheating and burning to pieces of the burner chamber if the combustion air is pumped into the burner chamber so that a substantial part of the combustion follows with a flame containing a radial component.

In order to solve the problem of overheating it has been suggested to cool the walls of the combustion chamber by introducing some portion of the combustion air radially inwards through the combustion chamber walls, but such method reduces the capacity of the burner and makes the combustion less good. It has also been suggested to provide several small evaporator tubes at some radius from the center of the burner chamber rather than one single central evaporator tube, but also in this case cooling is necessary by introducing some amount of the air through the burner chamber walls, and in addition thereto the apparatus is relatively expensive.

According to the invention the evaporator tube is formed with a sharp-edged U-bow, and a portion of the combustion air is used both for cooling the evaporator tube and to improve the decomposition of the fuel during the flow thereof through the evaporator tube, and the combustion air is introduced substantially in an axial direction in a counter current relationship to the injected fuel. Forming the U-bow with sharp edges is advantageous in that the fuel by the sharp change of flow direction is acted upon mechanically which facilitates and accelerates the decomposition of the fuel, and the fuel is also given a turbulence movement which facilitates the mixing of air and fuel at the same time as the temperature is evenly distributed in the fuel and the evaporator fuel is somewhat cooled. By introducing some portion of the combustion air already into the evaporator tube, preferably at a place advanced of the place at which the evaporator tube enters the combustion chamber it has proved that a substantially improved decomposition of the fuel into small drops is obtained and that a substantially more even combustion is obtained giving a low amount of carbon monoxide and nitrogen monoxide in the combustion gases. At the same time the cold air which is mixed with the fuel provides some cooling of the evaporator tube.

Extensive tests have proved that the dimensions of the evaporator tube are of great importance for the good function of the apparatus, and at least the following parameters have to be studied:

the volume of the tube considering the pressure drop of the fuel or of the combustion air and the possibility of mixing the fuel and the combustion air;

the mass relationship between fuel and combustion air;

outer heat transmitting area of the tube which must be sufficiently large to allow evaporization of a maximum amount of fuel but which must still be so small that the tube is not burnt at low amount of fuel;

the form of the bow of the evaporator tube;

the amount of combustion air which is mixed with the fuel in the evaporator tube.

Extensive tests have proved that the portion of the evaporator tube which is located inside the combustion chamber should have a relationship between the outer area and the volume of the tube which is within predetermined limits, viz. between 0.3 and 0.8 or preferably 0.35 and 0.50. Mathematically the said relationship can be expressed as follows:

$$\frac{\pi \cdot Dy \cdot L}{\frac{\pi \cdot (di)^2 \cdot L}{4}} = \frac{4\,Dy}{(di)^2} = 0.3 - 0.8 > 0.35 - 0.50$$

in which formula Dy is the outer diameter of the evaporator tube, di is the inner diameter of the evaporator tube and L is the total length of the portion of the evaporator tube which is located inside the burner chamber. Empirically it has shown that the value 4 Dy: $(di)^2$ should be between 0.3 and 0.8 or preferably between 0.35 and 0.50, and as evident from the above formula the value is independent of the length of the evaporator tube. It has also been proved that the value is also relatively independent of the type of the fuel which is used.

It is obvious that a value of 4 Dy: $(di)^2$ of less than 0.3 gives relatively coarse tubes which provides low flow speeds of the fuel, relatively large drops and impaired combustion and impaired mixture of air and fuel. A value of more than 0.8 gives narrow tubes with a high flow speed of the fuel or the fuel-air mixture which may give pressure shocks and smoke, and an impaired mixture is obtained of the fuel and the portion of the combustion air which is supplied to the evaporator tube.

It has also been proved that the length relationship between the different portions of the evaporator tube, i.e. the inlet portion, the 90° portion and the 180° portion may have some influence on the decomposition and the evaporization of the fuel and the mixing ability of the fuel with the combustion air in the combustion chamber. Consequently the 180° portion or the mouth of the evaporator tube ought to be longer than the 90° portion. In order to provide a good evaporization of the fuel, a good mixture of the fuel with the air which is supplied directly to the evaporator tube and a good mechanical decomposition of the fuel the inlet portion of the tube should be substantially longer than the 90° portion. However the mutual relationship of length between the different portions has to be calculated considering the intended capacity, i.e. the maximum amount of injected fuel, the flow speed of the fuel and air etc. Preferably an essential amount of the inlet portion is located inside the combustion chamber so that the said portion assimilates the combustion heat and provides a good evaporization of the fuel. The end or outlet of the 180° portion ought to be located so far from the bottom of the combustion chamber that the fuel or the fuel-air mixture is substantially completely combusted or turned in the direction out of the combustion chamber before it reaches the bottom of the combustion chamber so that the fuel is not sprayed on to the said bottom of the combustion chamber.

As mentioned above it is an object to give the burner as small dimensions as possible, but thereby there is a problem to avoid such high temperatures that the walls of the burner chamber are damaged, for instance in that scaling phenomena appear. It is known for instance in connection with jet motors to introduce additional air radially inwards into the combustion chamber through the combustion chamber walls, but thereby the combustion temperature is lowered and a less good combustion is obtained, especially since it is not possible to effectively control the relationship between fuel and air. In the case of the jet motor it is a wish to obtain as high gas pressure as possible whereas there is no intention to provide as high combustion temperature as possible, as complete combustion as possible and to keep the dimensions of the burner as small as possible. The said previously known method is therefore not suitable in the present case. Another object of the invention therefore is to provide a burner having as high capacity as possible and as complete combustion as possible and as small dimensions as possible, and in which the problem of injuring or overheating of the walls of the combustion chamber is solved.

According to another aspect of the invention the said problem is solved in that the inlet for the combustion air is provided at the bottom of the combustion chamber so that the combustion air enters the combustion chamber substantially in an axial direction and in that the inlet comprises several radial slots each of which has a flow directing wing which give the flow of air a screw movement to the effect that a very effective mixture of air and fuel is obtained and whereby the combustion follows practically unitarily and without heat concentration to the walls of the combustion chamber as in the previously known embodiments. In a special embodiment of the invention the combustion air is also introduced through a labyrinth passageway outside the cup formed combustion chamber so that the cold combustion air in counter current to the combustion direction is allowed to sweep along the walls of the combustion chamber thereby cooling the said walls before the air enters the air inlet at the bottom of the combustion chamber.

Figure 2:
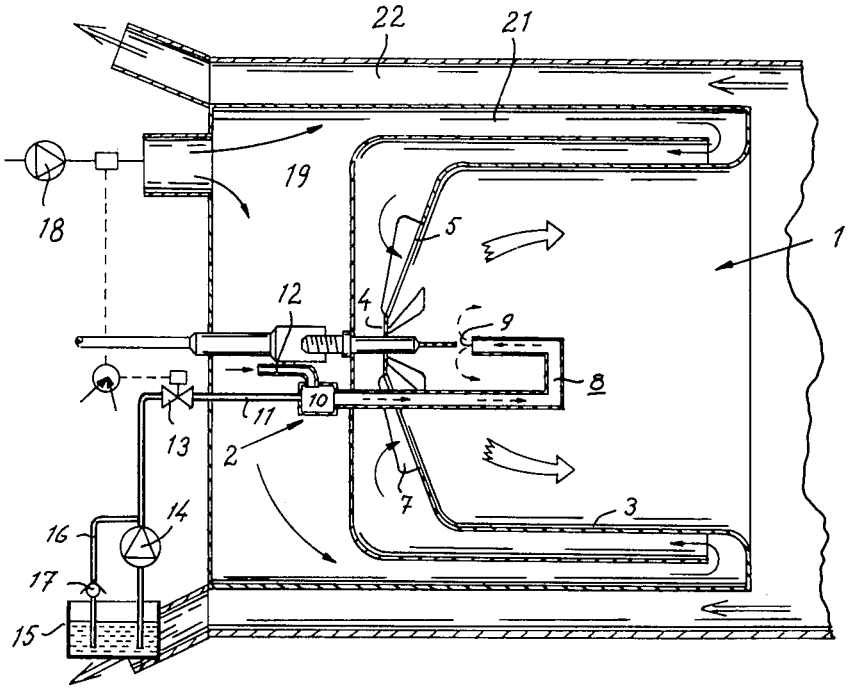
Figure 3:
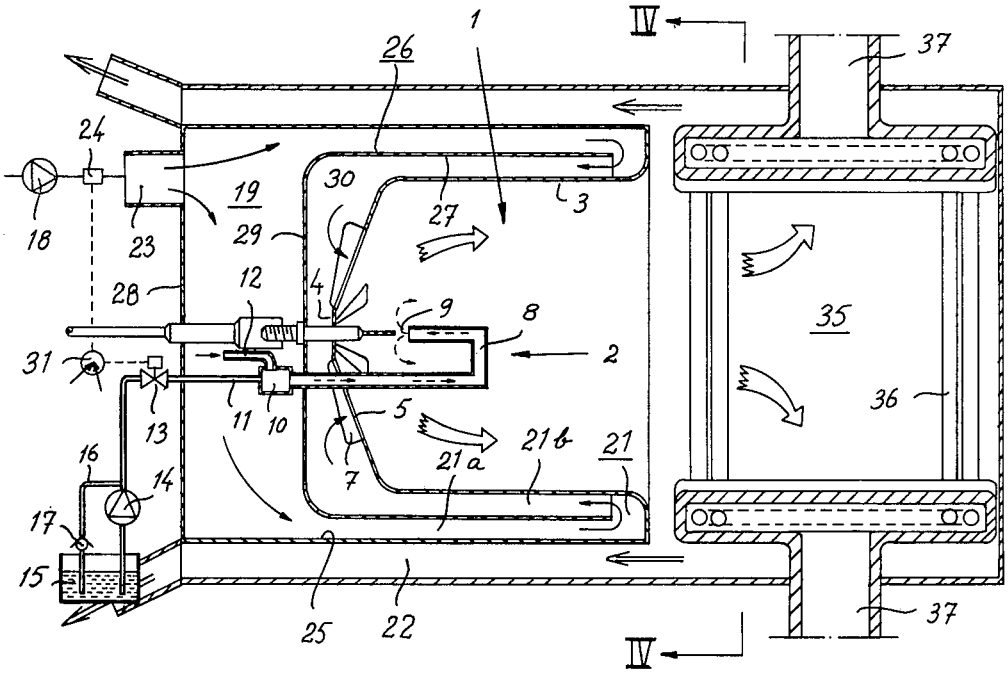
Figure 4:
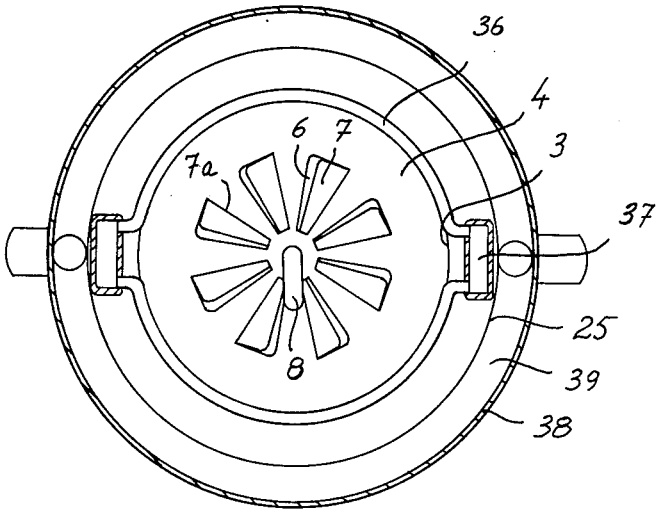

In the following the invention will be described more in detail with reference to the accompanying drawings which illustrate preferred embodiments of the invention. In the drawings FIG. 1 diagrammatically illustrates a preferred embodiment of a burner according to the invention for combusting liquid, gaseous or solid fuels shown in full scale, FIG. 2 is an axial cross section through a burner having a combustion tube of the type which is illustrated in FIG. 1, FIG. 3 is an axial cross section through a burner according to the invention applied to an apparatus for heating a heat transferring medium, and FIG. 4 is a cross section along line IV—IV of FIG. 3.

FIG. 1 generally shows a combustion chamber 1 having a burner 2 according to the invention.

In the conventional way the combustion chamber is formed as a cup having combustion chamber walls 3 and a combustion chamber bottom 4 which is preferably slightly concave or diverges conically in the direction outwards. In the bottom 4 of the combustion chamber there is an inlet for air provided by several air slots 5 provided radially around the center 6 of the combustion chamber and which may be formed with flow directing wings 7 which give the entering combustion air a rotating movement.

The burner 2 comprises a burner tube or evaporator tube 8 which extends through the bottom 4 of the combustion chamber and the mouth 9 of which is located inside the combustion chamber 1. The evaporator tube 8 is composed of three tube portions which are connected at about 90° to each other. The inlet portion **8*a* of the vaporator tube extends axially into the combustion chamber through the bottom 4 thereof, and from the end of the inlet portion 8*a* an intermediate portion 8*b* extends at 90° angle and from said intermediate portion an outlet portion 8*c*** extends which is turned at a further angle of about 90° thereof.

At the inlet end of the inlet portion **8*a* the evaporator tube is formed with a mixing chamber 10 for fuel and air, and in the said mixing chamber 10 a fuel conduit 11 and an air conduit 12 open. As best illustrated in FIG. 2 the fuel conduit 11 is connected to a source of fuel 15 via a control valve 13 and a fuel pump 14. The source of fuel 15 can be a tank or a container for liquid, gaseous or powdered fuel. At the inlet side the fuel pump 14 is connected to a return conduit 16 having a return valve 17 for making a continuous operation possible of the fuel pump 14 irrespectively of the position of the control valve 13. The fuel pump 14** can be of a relatively simple type which gives a relatively low pressure since the burner according to the invention does not require fuel of high pressure.

The air conduit 12 is in turn connected to a source of introducing a flow of air like an air pump 18 as illustrated in FIG. 2, which is preferably connected to an air chamber 19 from which all combustion air is received and from which a little portion of the combustion air is shunted off to the air conduit 12. The air pump 18 may like the fuel pump 14 be of a simple type since the burner according to the invention does not need a high pressure of the air either.

According to the invention some air is mixed with fuel in the mixing chamber 10 before the fuel enters the evaporator tube 8, and it has been proved that the said introduction of air has a very good effect for providing an optimum good combustion giving low contents of carbon monoxide and nitrogen oxides. The introduction of air into the mixing chamber 10, however, must be within predetermined limits. When introducing air into the mixing chamber in an amount of up to 8% by weight of the total amount of combustion air the combustion is continuously improved and the contents of carbon and nitrogen oxides are reduced probably for the reason that the introduced amount of air facilitates the mechanical decomposition of the fuel to small drops and also facilitates the thermic influence on the fuel to vaporize the fuel. From an amount of 8–15% by weight of introduced air and further on only a slightly improved combustion can be noticed, but when the amount of introduced air reaches an amount of 15–20% by weight there may be a risk that the fuel-air mixture is fired already within the evaporator tube which gives an impaired combustion and a risk of overheating of the evaporator tube and burning damages depending thereon. The introduced air can have a low temperature, preferably the ambient air temperature, and thereby the air assists in cooling the evaporator tube thereby preventing overheating and burning of said tube. If the amount of air introduced into the mixing chamber is in the area adjacent the upper limit of 15–20% by weight there is however a risk that the air provides a too strong cooling of the fuel air mixture, especially at high power and large flow speed of the fuel-air mixture, which give an impaired combustion. Considering the possibility of controlling the burner the amount of introduced air should be between 4 and 15% by weight or preferably 8–12% by weight.

Tests have been made with evaporator tubes having a rounded turn-around portion, but it has proved that this gives a less good combustion and at the same time the risk of overheating of the evaporator tube increases at the turns portion thereof. It is therefore important that the evaporator tube be turned by sharp edges. The evaporator tube may have any suitable cross section form, but preferably it is made of circular tubes.

In order to provide an effective combustion without the risk of overheating the walls of the combustion chamber the combustion air is introduced axially through the bottom 4 of the combustion chamber 1, and the evaporator tube 8 is mounted so that the outlet portion **8*c* thereof extends axially and concentrically with the shaft 6 of the combustion chamber. To further reduce the risk of overheating the walls of the combustion chamber the amount of the combustion air which is introduced through the bottom 4 of the combustion chamber 1 can be brought to flow in a labyrinth 21 as illustrated in FIG. 2, whereby the combustion air in counter current to the exhaust gases cools the walls 3 of the combustion chamber 1 during its rearward flow to the bottom 4 of the combustion chamber. In a corresponding way the exhaust gases may also be cooled by being fed rearwardly in an exhaust gas chamber 22, whereby the medium to be heated by the burner is provided in an area adjacent the mouth of the combustion chamber so that the hot combustion gases pass or are fed through the said medium before entering the exhaust gas chamber 22**.

In the embodiment of the invention in FIG. 3 the combustion chamber 1 is formed as a circular cylinder which is composed by walls 3 and bottom 4 in which the inlet 5 for the combustion air is provided. The combustion chamber should be so long that the combustion is substantially completed when the fuel-air mixture leaves the combustion chamber and it may as in the illustrated embodiment have a relationship of length to diameter of about 1:1, but depending on the operation conditions the said relationship may be greater or less than 1:1. The air inlet at the bottom of the combustion chamber is formed by several slots 5 having flow directing wings 7 which are turned out from the said bottom.

The flow directing wings 7 are punched out of the combustion chamber bottom but are integral therewith along one edge 7*a* thereof and they are turned down to an angle of about 25° from the bottom 4 of the combustion chamber. In the illustrated case the number of air slots is eight and together with the flow directing wings 7 they provide a turbulator inlet by which the air is given a screw type movement when passing said inlet. In order to give the best air flow the bottom 4 of the combustion chamber diverges conically outwards over a cone angle of about 140°. In order to give a silent operation and the best possible combustion also the walls 3 of the combustion chamber may diverge slightly in the direction outwards, for instance over an angle of 5–10°.

It has been proved that the above mentioned addition of air to the fuel passing the fuel conduit 11 is particularly advantageous in case of liquid fuels in which the amount of air further assists in reducing the size of the fuel drops and thereby accelerates and improves the evaporation of the fuel. The combustion air is received from the air chamber 19, which is sealingly connected to the outer end of the combustion chamber 1, and which is formed with an air inlet, by which air is supplied by means of the pump or fan 18 over a control valve 24. Between the walls 3 of the combustion chamber and the outer walls 25 of the air chamber 19 an annular space is formed which is divided into the air labyrinth 21 by means of a labyrinth body of 26 which with the walls 27 thereof extends into the said annular space dividing same into two substantially like parts. The outer end of the labyrinth body 26 is spaced from the end of the air chamber 19 to allow a turnover of the air from the outer labyrinth part 21*a* to the inner labyrinth part 21*b*. Between the bottom 28 of the air chamber 19 and the bottom 29 of the labyrinth body 26 the air inlet chamber 19 is formed, from which the main portion of the air is introduced into the combustion chamber over the labyrinth 21*a* and 21*b* respectively and an expansion chamber 30 which is formed between the combustion chamber bottom 4 and the labyrinth body bottom 29. When passing the outer labyrinth part 21*a* the flow speed of the air increases, and the flow speed is further increased when the air passes the inner labyrinth part 21*b*, whereupon the flow speed is allowed to decrease in the expansion chamber 30 from which the air is introduced into the combustion chamber with a relatively low speed through the air slots 5 of the combustion chamber.

The amount of combustion air and the amount of fuel is controlled by means of the valves 13 and 24 respectively, which valves are preferably interconnected by a common control means 31. The incoming combustion air which at the inlet 23 has the ambient temperature is slowly heated during the passage through the outer labyrinth passageway 21*a* and it is further increased but to a substantially increased degree when passing the inner labyrinth passageway 21*b* at the same time as the air cools the combustion chamber walls 3 in counter current to the flow direction of the combustion gases since the temperature of the air is substantially lower than the temperature of the combustion gases.

In a particular embodiment of the invention, in which the combustion chamber had a diameter of 107 mm, a length of 115 mm and in which 1.5 g liquid fuel was pumped through the evaporator tube per second, corresponding to a power of 50 kW a maximum temperature of about 2200° C. was obtained in the combustion gases, whereas the combustion air at the inlet 23 had a temperature of about 20° C. and a temperature in the expansion chamber 30 of 750° C. Thanks to the cooling of the combustion chamber walls 3 by means of the combustion air the temperature of the said walls 3 could be kept substantially under the critical temperature corresponding to the scaling temperature which in this case was 1150° C. Also thanks to the effective cooling by means of the combustion air and the special inlet flow turbulator at the bottom of the combustion chamber a very high power could be effected with a very little volume of the burner.

In FIGS. 3 and 4 the burner is connected to a heater 35 for water, gas, air or any other medium. A very special field of use is hot air or hot gas motors in which the operator air or operation gas must be quickly heated to a very high temperature, and in this case the heater 35 is formed as a closed air or gas channel system having heat receiving tubes 36 of which only four are illustrated, and collectors 37. The heat receiving tubes 36 are mounted as coils extending axially just outside the combustion chamber 1, whereby the combustion gases are allowed to pass between the heat receiving tubes 36 and out through an exhaust channel 39. The said exhaust channel 39 is formed between the outer walls 25 of the air chamber 19 and an exhaust casing 38 which encloses both the burner 2 and the heater 35. The exhaust gases passing in the direction rearwards through the exhaust channel 39 are cooled in counter current with the air passing the outer labyrinth 21*a*.

In order to provide an ignition of the fuel-air mixture when the burner is cold an ignition plug 40 is provided in the combustion chamber in front of the mouth 9 of the evaporator tube 8, and the ignition plug 40 is in a way known per se connected to a source of electric current (not illustrated) to provide a firing spark. Alternatively the ignition plug 40 can be mounted in the mixing chamber 10 or at any other place of the evaporator tube 8. A firing can also be provided by increasing the amount of air in relation to the amount of fuel to such relationship that the fuel-air mixture is fired.

The above described apparatus operates at low pressure of the fuel and low flow speed of the combustion air and therefore it is possible to use simple pumps 14 and 18 respectively and there are no special sealing problems like in the priorly known high pressure systems. Depending on the relatively low pressure of the fuel and flow speed of the air an effective combustion is obtained within a short distance from the outflow point of the fuel, and this also opens possibilities of using powdered fuels like carbon powder etc. what is also made possible thanks to the relatively large inner area of the evaporator tube.

It is to be understood that the above specification and the embodiments of the invention illustrated in the drawings are only an illustrating example and that all kinds of modifications may be presented within the scope of the appended claims.

What we claim is:

1. Apparatus for combusting fuels comprising a combustion chamber having air inlet means at the bottom thereof for introducing combustion air and having a relatively wide burner tube, a substantial length of which is located inside the combustion chamber and which opens inside the combustion chamber and which is turned twice at about 90° at each turn, characterized in that the burner tube opens inside the combustion chamber with a mouth facing the bottom of the combustion chamber substantially co-axially therewith, in that an inlet end of the burner tube is located outside the combustion chamber and is connected to a mixing chamber, in which both fuel and some amount of combustion air is introduced and mixed before the fuel-air mixture is brought to flow through the burner tube, in that the combustion chamber is surrounded by an air chamber providing a labyrinth channel through which combustion air is passed to the air inlet means at the bottom of the combustion chamber while being preheated, and, in that the air chamber includes an inlet air receiving chamber provided behind the combustion chamber and connected to the labyrinth channel, whereby combustion air is supplied to the labyrinth channel from the inlet air receiving chamber.

2. Apparatus according to claim 1, characterized in that the burner tube (8) has thin walls and in that the relationship between surface area of the burner tube (8) and the volume thereof is 0.3–0.8 .

3. Apparatus according to claim 1, comprises on air inlet means at the bottom (4) of the combustion chamber (1) is substantially axial and comprises several air slots (5) each having a flow directing wing (7) imparting a spiral-type movement to the incoming flow of air

4. Apparatus according to claim 3, characterized in that the air slots (5) are provided radially and evenly distributed over the bottom (4) of the combustion chamber (1) and in that the flow directing wings (7) are bent outwards at an angle of about 25° C. from the bottom (4) of the combustion chamber.

5. Apparatus according to any of claims 1, characterized in that the bottom of the combustion chamber diverges in the direction outwards over a cone angle of about 140°.

6. Apparatus according to claim 1, characterized in that the air chamber (19) is an annular space (21) surrounding the walls (3) of the combustion chamber (1) and in that the said space (21) is divided into a flow labyrinth by a labyrinth body (26) which with a wall (27) thereof is mounted in the said annular space (21) thereby providing an outer labyrinth channel **(21*a*) and an inner labyrinth channel (21*b*)**.

7. Apparatus according to claim 6, characterized in that the air chamber includes an inlet air receiving chamber (19) provided behind the combustion chamber (1) and connected to the outer labyrinth channel **(21*a*), whereby the combustion air is first brought to pass throughthe outer labyrinth channel (21*a*) and thereafter into the inner labyrinth channel (21*b*) in counter current to the combustion gases in the combustion chamber (1)**.

8. Apparatus according to claim 6 or 7, characterized in that the labyrinth body (26) provides an expansion chamber (30) for the combustion air located between the labyrinth body (26) and the bottom (4) of the combustion chamber (1), from which chamber (30) the combustion air enters the air inlet (5) of the combustion chamber.

9. Apparatus according to claim 1, characterized in that the mixing chamber (10) at the inlet end of the burner tube (8) is provided outside the combustion chamber (1).

10. Apparatus according to claim 1, characterized in that the burner tube has thin walls and in that the relationship of surface area of the burner tube from the mixing chamber to the outlet end and the total volume of the corresponding part of the burner tube is 0.3–0.8 or preferably 0.35–0.50.

11. Apparatus according to claim 1 or 10, characterized in that there are several air inlets at the bottom of the burner chamber substantially evenly distributed thereabout.

12. Apparatus according to claim 1, characterized in that there are several air inlets evenly distributed at the bottom of the burner chamber and each having a flow directing wing giving the incoming flow of air a screw type movement.

13. Apparatus according to claim 1, characterized in that there are several elongated air inlets provided radially and evenly distributed over the bottom of the combustion chamber and each having a flow directing wing bent back at an angle of about 25° from the bottom of the combustion chamber.

14. Apparatus for combusting fuels comprising a combustion chamber having air inlet means at the bottom thereof for introducing combustion air and having a relatively wide burner tube, a substantial length of which is located inside the combustion chamber and which opens inside the combustion chamber and which is turned twice at about 90° at each turn, characterized in that the burner tube opens inside the combustion chamber with a mouth facing the bottom of the combustion chamber substantially co-axially therewith, in that an inlet end of the burner tube is located outside the combustion chamber and is connected to a mixing chamber, in which both fuel and some amount of combustion air is introduced and mixed before the fuel-air mixture is brought to flow through the burner tube, in that the combustion chamber is surrounded by an air chamber providing a labyrinth channel through which combustion air is passed to the air inlet means at the bottom of the combustion chamber while being preheated, and, in that the labyrinth channel is formed with an expansion chamber for combustion air located between the labyrinth channel and the bottom of the combustion chamber, from which combustion air enters the air inlet means of the combustion chamber.

15. Apparatus for combusting fuels comprising a combustion chamber having air inlet means at the bottom thereof for introducing combustion air and having a relatively wide burner tube, a substantial length of which is located inside the combustion chamber and which opens inside the combustion chamber and which is turned twice at about 90° at each turn, characterized in that the burner tube opens inside the combustion chamber with a mouth facing the bottom of the combustion chamber substantially co-axially therewith, in that an inlet end of the burner tube is located outside the combustion chamber and is connected to a mixing chamber, in which both fuel and some amount of combustion air is introduced and mixed before the fuel-air mixture is brought to flow through the burner tube, in that the combustion chamber is surrounded by an air chamber providing a labyrinth channel through which combustion air is passed to the air inlet means at the bottom of the combustion chamber while being preheated, and, in that the labyrinth channel is surrounded by an exhaust gas channel adapted to further preheat the combustion air.

* * * * *